US006041988A

United States Patent [19]

Shapiro

[11] Patent Number: 6,041,988

[45] Date of Patent: Mar. 28, 2000

[54] METHOD FOR CUTTING FABRIC

[76] Inventor: Donald A. Shapiro, 46 Ramblewood Road, Vermette, Manitoba, Canada

[21] Appl. No.: 09/204,685

[22] Filed: Dec. 3, 1998

[51] Int. Cl.[7] ..... B26F 3/00

[52] U.S. Cl. ..... 225/1; 225/93; 83/13; 83/614; 83/659; 83/936

[58] Field of Search ..... 83/614, 940, 939, 83/936, 171, 455, 13, 659, 658, 56; 26/7, 10.4, 11, 11.4, 69 C; 28/170; 264/160; 225/1, 93

[56] References Cited

U.S. PATENT DOCUMENTS

| | | | |
|---|---|---|---|
| 1,914,528 | 6/1933 | Reid | 83/176 |
| 2,108,178 | 2/1938 | Rosenberg . | |
| 2,467,585 | 4/1949 | Finkelstein . | |
| 3,143,023 | 8/1964 | Addin | 83/614 X |
| 3,176,572 | 4/1965 | Comet . | |
| 3,496,817 | 2/1970 | Staats et al. | 83/614 X |
| 3,821,915 | 7/1974 | Larrable . | |
| 4,069,729 | 1/1978 | Kuts | 83/614 X |
| 4,152,962 | 5/1979 | Hendrischk | 83/614 X |
| 4,426,901 | 1/1984 | Hogan et al. | 83/16 X |
| 4,448,808 | 5/1984 | Pearl | 83/940 X |
| 5,036,740 | 8/1991 | Tsai | 83/614 X |
| 5,243,890 | 9/1993 | Ober | 83/614 X |
| 5,355,754 | 10/1994 | Baker . | |

*Primary Examiner*—Rinaldi I. Rada
*Assistant Examiner*—Ana Luna
*Attorney, Agent, or Firm*—Adrian D. Battison; Murray E. Thrift

[57] ABSTRACT

A sheet material primarily fabric is cut by providing an anvil having an substantially cylindrical wire thereon defining a cutting line lying along the anvil and supported thereby, by draping the fabric over the anvil and by running along the wire of the anvil the peripheral surface of a roller so as to apply pressure between the roller surface and the wire. The fabric is thus compressed between the roller surface and the wire in a pinching action which causes the wire to engage into and effect cutting of the fabric along the cutting line. The roller is mounted on a carriage running along the anvil and is spring biased onto the wire.

26 Claims, 2 Drawing Sheets

METHOD FOR CUTTING FABRIC

BACKGROUND OF THE INVENTION

This invention is concerned with the cutting of fabric. The apparatus and method can be used for cutting sheet materials but is primarily designed for the cutting of fabric. Sheet material such as plastics materials can readily be slit simply by a stationary blade. The cutting of fabric with fibers in various directions is more difficult since the fibers can catch onto a blade and thus be pulled interfering with the cutting action and possibly damaging the fabric. It is necessary therefore to provide regularly sharpened blades for the cutting action when cutting fabric containing fibers of this type. Generally a cutting action is effected using a disc shaped blade with a sharpened outer edge which is driven in rotation as the blade is moved across the sheet of fabric to be cut. This arrangement is relatively complex, requires relatively complex sharpening devices for maintaining the blade sharpened and also requires regular replacement of the blade since the sharpening action tends to wear the blade to a condition when it can no longer be used. The blades themselves are relatively expensive.

U.S. Pat. No. 2,108,178 (Rosenberg) issued Feb. 15, 1938 discloses a press for pinking leather.

U.S. Pat. No. 2,467,585 (Frinkelstein) issued Apr. 19, 1949 discloses a cutting knife with a blade which is pressed down onto a fabric sheet to effect cutting of a curved portion of the fabric, the blade having a notch to define identification mark on the fabric.

U.S. Pat. No. 3,176,572 (Comet) issued Apr. 6, 1965 discloses a device for slitting and cutting tape using a press blade.

U.S. Pat. No. 5,355,754 (Baker) issued Oct. 18, 1994 discloses a carpet seam cutter in which a sharpened blade mounted on a support base is mounted at an edge of a carpet piece and the next adjacent piece is overlapped with the first piece and then cut to butt with the first piece by hammering the carpet onto the blade edge.

None of these patents provide a device which is helpful or suitable for the cutting of fabric and to solve the problems of the re-sharpening of the disc shape knife which is necessary with previous fabric cutting devices.

SUMMARY OF THE INVENTION

It is one object of the present invention, therefore, to provide an improved method for cutting fabric which avoids the use of knives which require regular maintenance and sharpening According to a first aspect of the invention there is provided a method for cutting fabric comprising:

providing an elongate anvil strip having an anvil surface defining a cutting line;

supporting the fabric so as to lie across the anvil surface with the fabric in contact with the anvil surface;

arranging the support and the anvil surface to hold the fabric stationary in contact with the anvil surface during cutting;

providing a roller having a peripheral roller surface;

driving the roller surface in a direction of rolling movement along the anvil surface while the roller rotates about an axis generally at a right angle to the direction of rolling movement;

applying pressure between the roller surface and the cutting line of the anvil surface so as to compress the fabric therebetween;

the roller surface and the anvil surface being formed from materials which are sufficiently rigid and the cutting line of the anvil surface being sufficiently narrow such that the pressure therebetween effects cutting of the fabric along the cutting line.

Preferably the anvil surface at the cutting line is free from a sharpened edge, that is the anvil surface is not a knife or other blade which would therefore require re-sharpening.

Preferably the anvil surface at the cutting line is curved in transverse cross-section. Thus the cutting action is effected by a pinching action on the fabric rather than by the action of a sharp blade.

Preferably the anvil surface at the cutting line is arcuate in transverse cross-section such as formed by a wire, bead or the like.

Preferably the anvil surface at the cutting line is defined by an outwardly facing side surface of a cylindrical wire. Such wires are therefore readily available and can be readily replaced when broken.

Preferably a side surface of the wire opposite the outwardly facing side surface is supported by a rigid bar to prevent bending thereof when the pressure is applied.

Preferably the roller is mounted on a carriage movable along the anvil surface.

Preferably the roller is spring biased onto the wire by a spring mounted on the carriage.

Preferably the carriage includes a pair of side members straddling the bar of the anvil surface so as to run along either side thereof across a generally horizontal fabric support table.

Preferably each of the side members includes a ramp surface for engaging and lifting the fabric.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
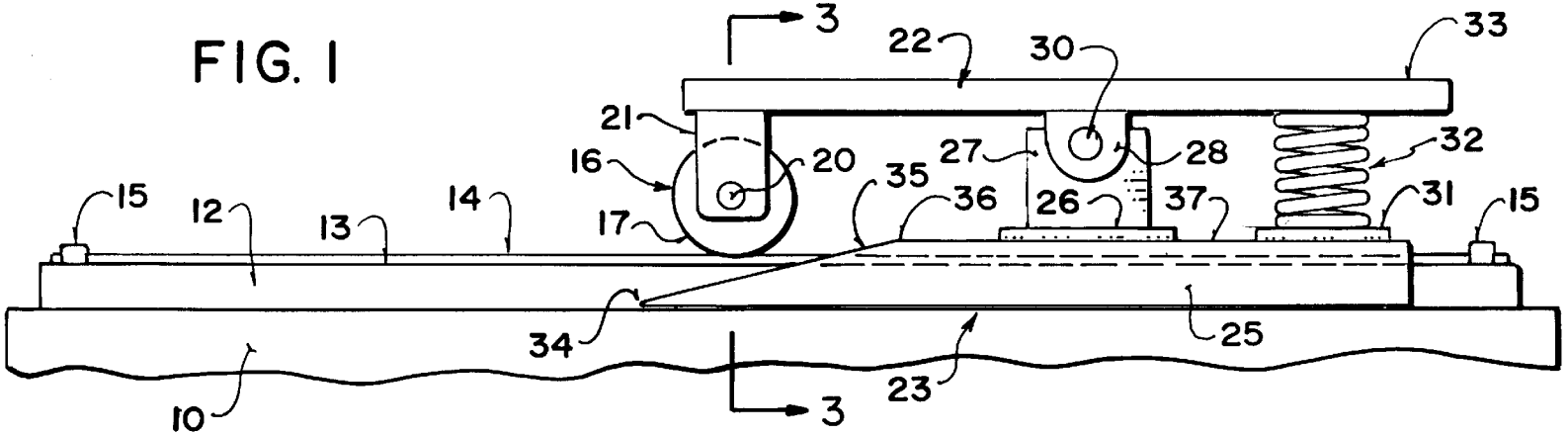
FIG. 1 is a side elevational view of an apparatus for cutting fabric according to the present invention.
Figure 2:
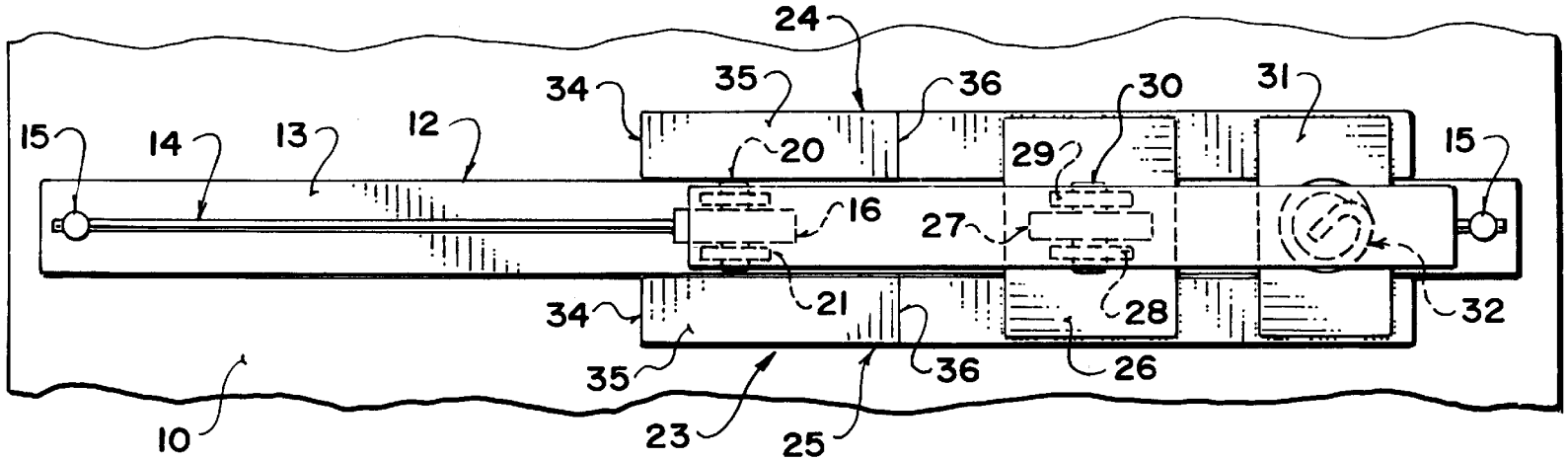
FIG. 2 is a top plan view of the apparatus of FIG. 1.
Figure 3:
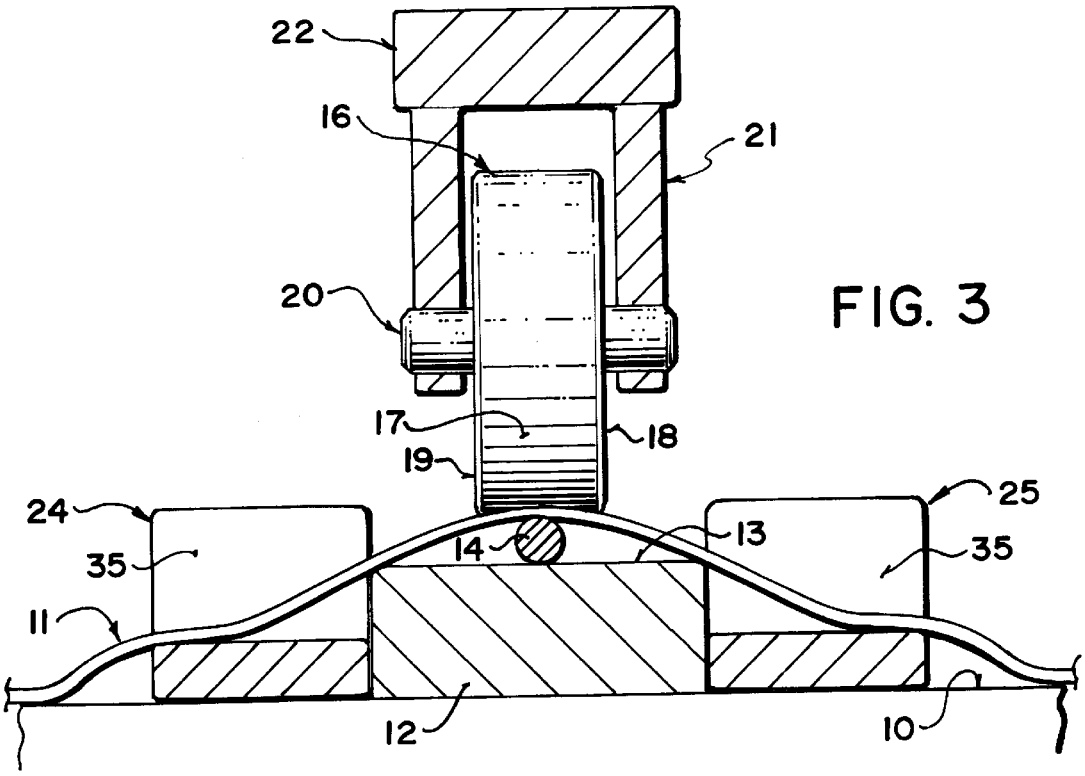
FIG. 3 is a cross-sectional view along the lines 3—3 of the apparatus of FIG. 1 on an enlarged scale.

An apparatus and method for cutting a sheet of fabric is shown in the Figures and comprises a fabric table 10 over which a fabric 11 to be cut is laid so that the fabric is stationary on the horizontal table and laid out ready for cutting.

Across the table is mounted an elongate rigid bar 12 having a flat top surface 13. The beam has sufficient stiffness such that it acts as a supporting surface during the cutting action.

On top of the horizontal top surface is attached a wire 14 which extends along a center line of the top surface and is attached at each end of the beam by suitable clamping devices schematically indicated at 15. The wire is thus held at tension and straight across the length of the beam.

The wire is a simple metal wire preferably formed of steel which has a smooth cylindrical outer surface. Tempered steel is preferred to mild steel as mild steel is more compressible and thus will lose its cylindrical shape more quickly. An example of a suitable wire is tempered or semi-tempered piano wire. The diameter of the wire is selected to be as small as possible bearing in mind that the diameter must be significantly greater than the compressed thickness of the fabric otherwise the fabric will flood the wire on either side of the wire and little cutting effect will occur. A small diameter reduces the width of the surface contacting the fabric and therefore increases the pressure on the fabric at the cut line. The diameter of the wire is therefore preferably in the range 1/32 to 1/64 inch.

The apparatus further includes a roller 16 which is arranged to roll along the length of the wire 14. The roller has an outer peripheral surface 17 which is cylindrical in shape and thus defines at the point of contact a horizontal contact surface portion which is wider than the wire and extends to side edges 18 and 19 of the roller. The surface 17 may be slightly crowned but its curvature is less than that of the wire so that it presents in effect a wider surface than the wire to the fabric 11.

The roller 16 is carried on a shaft 20 which defines an axis of rotation of the roller which is at right angles to the wire and spaced above the wire.

The roller is mounted on the shaft on suitable bearings which allow the peripheral surface 17 to rotate relative to the shaft while the shaft is held stationary. The shaft is carried in a yoke 21 defined by a pair of side legs connecting to a top plate 22.

The roller and the top plate are mounted on a carriage 23 which slides across the table 10 at the bar 12. The carriage 23 includes a pair of side guide members 24 and 25 which are spaced by the width of the bar 12 so that an inside surface of each of the side rails 24 and 25 contacts the bar and runs along the bar thus guiding the carriage in movement parallel to the bar.

The side rails are connected by a top plate 26 which bridges the side rails and provides a mount for a central support post 27 carried on the plate. The post is positioned between the side rails and stands upwardly therefrom and the post is relatively narrow so that it is narrower than the bar 12.

The top plate 22 is pivotally mounted on the post 27 by a pair of depending side plates 28 and 29 and a transverse pivot shaft 30 extending through the post and through the side plates.

A second connecting plate 31 adjacent to but spaced rearwardly from the plate 26 spans the side rails 24 and 25 and provides a support for the bottom of a biasing spring 32 which pushes a rear end 33 of the top plate 22 upwardly thus applying downward pressure onto the roller 16.

Each of the side rails 24 and 25 has a front nose 34 and an upwardly and rearwardly extending ramp surface 35 extending rearwardly from the nose 34 to a forward edge 36 of a horizontal top surface 37 of the side rail. Thus the surfaces 35 define ramp surfaces which commence at a height lower than the wire 14 and extend to a height greater than the wire 14 at the rear edge 36.

In operation, the carriage 23 is moved to one end of the bar 12 at a position spaced from the area to receive the fabric. The fabric is then pulled across the table and laid over the bar with the intended cut line of the fabric located directly on top of the wire. The carriage is then moved so that the roller runs along the wire until the roller encounters the fabric. At this point the roller runs up on top of the fabric and applies downward pressure onto the fabric thus pinching the fabric between the peripheral surface 17 of the roller and the top surface of the wire.

Figure 4:
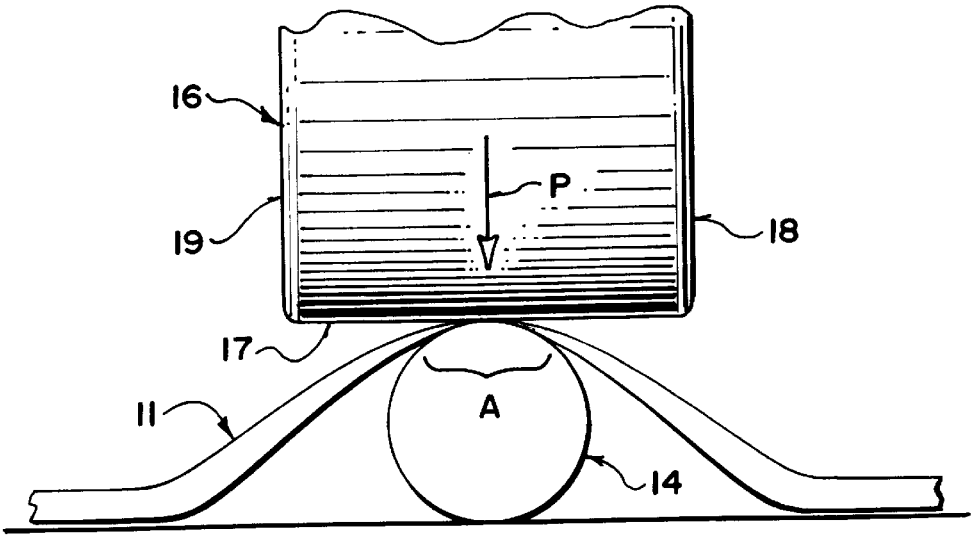
FIG. 4 is a cross-sectional view across the roller and wire of the apparatus on a further enlarged scale showing the cutting action.

As best shown in FIG. 4, the wire is of circular cylindrical shape so that its area indicated at A at which it contacts the fabric is smoothly curved and preferably arcuate. In this area there is no cutting edge and no sharpened knife edge.

As shown in FIG. 4, therefore, the cutting action is effected by the downward pressure P of the roller onto the arcuate curved area A thus pinching the fabric with a pinching effect being maximized at the upper most line along the wire thus causing sufficient pinching action at this location to effect severing of the fabric at this point.

Both the roller and the wire have outside surfaces manufactured of materials which are sufficiently rigid or hard so that they do not deform but instead simply effect a pinching action on the fabric. The amount of spring pressure is selected so that the pinching action is sufficient to sever the fabric at the point of maximum contact between the roller and the wire. This point of maximum contact is relatively small since the roller is curved in one direction and the wire is curved in the opposite direction thus concentrating all of the forces at the very small area of contact therebetween. These forces are sufficient in practice to sever the fabric by the pinching action.

Fabric of various different types can be severed in this manner and in commercially available type fabrics used for clothing, the system is suitable for severing fine silk up to relatively heavy denim of the order of 14 ounce denim.

The cutting action occurs without any severing by knife blade so that there is no danger of the fibers of the fabric being caught on burrs on the blade and pulled.

Provided the wire retains its cylindrical shape and provide the roller avoids the formation of a groove, the point of contact is maintained sufficiently small to effect the severing action. Even when the wire begins to deform and the roller begins to form a groove, replacement of these items is relatively inexpensive since they are commercially available and non specialized items. Thus the roller can be formed by the outside race of a conventional bearing since the race is formed from hardened steel which has the required characteristics to maintain its shape without deformation and without formation of a groove at the wire.

The ramp surfaces guide the fabric after it has been slit or severed by the pinching action so that the fabric passes on each side of the post supporting the roller and on each side of the spring.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A method for cutting sheet material comprising:

providing an anvil member having an elongate raised anvil surface defining a cutting line;

supporting the sheet material so as to lie across the anvil member such that the raised anvil surface projects from the anvil member toward the sheet material;

supporting the sheet material to hold the sheet material stationary relative to the anvil surface and in contact with the anvil surface during cutting;

providing a roller having a peripheral roller surface;

causing relative movement between the roller and the anvil surface such that the roller surface is moved in a direction of rolling movement along the anvil surface while the roller rotates about an axis generally at a right angle to the direction of rolling movement;

applying pressure between the roller surface and the raised anvil surface so as to compress the sheet material between the roller surface and the raised anvil surface;

arranging the roller surface so as to be wider then the raised anvil surface and such that the roller surface applies a pressure to the sheet material pressing the sheet material onto the raised anvil surface to form a pinching action of the sheet material on the raised anvil surface;

and arranging the raised anvil surface such that the pinching action causes the raised anvil surface to engage into and effect cutting of the sheet material along the cutting line.

2. The method according to claim 1 wherein the raised anvil surface is free from a sharpened edge.

3. The method according to claim 1 the raised anvil surface is curved in transverse cross-section.

4. The method according to claim 1 wherein the raised anvil surface is arcuate in transverse cross-section.

5. The method according to claim 1 wherein the roller is mounted on a carriage movable along the anvil member.

6. The method according to claim 5 wherein the roller is spring biased toward the anvil surface by a spring mounted on the carriage.

7. The method according to claim 5 wherein the anvil member includes a rigid elongate bar and wherein the carriage includes a pair of side members straddling the elongate bar.

8. The method according to claim 7 wherein each of the side members includes a ramp surface for engaging and lifting the sheet material.

9. A method for cutting sheet material comprising:

providing an anvil member having an substantially cylindrical wire thereon defining a cutting line lying on the anvil member and supported thereby;

supporting the sheet material so as to lie across the anvil member such that the raised wire projects from the anvil member toward the sheet material;

supporting the sheet material to hold the sheet material stationary relative to the wire and in contact with the wire during cutting;

providing a roller having a peripheral roller surface;

causing relative movement between the roller and the wire such that the roller surface is moved in a direction of rolling movement along the wire while the roller rotates about an axis generally at a right angle to the direction of rolling movement;

applying pressure between the roller surface and the wire so as to compress the sheet material between the roller surface and the wire;

arranging the roller surface so as to be wider than the wire and such that the roller surface applies a pressure to the sheet material pressing the sheet material onto the wire to form a pinching action of the sheet material on the wire;

and arranging the wire such that the pinching action causes the wire to engage into and effect cutting of the sheet material along the cutting line.

10. The method according to claim 9 wherein the roller is mounted on a carriage movable along the anvil member.

11. The method according to claim 10 wherein the roller is spring biased toward the wire by a spring mounted on the carriage.

12. The method according to claim 10 wherein the anvil member includes a rigid elongate bar and wherein the carriage includes a pair of side members straddling the elongate bar.

13. The method according to claim 12 wherein each of the side members includes a ramp surface for engaging and lifting the sheet material.

14. Apparatus for cutting sheet material comprising:

an anvil member having an elongate raised anvil surface defining a cutting line and arranged such that, with the sheet material lying stationary across the anvil member, the raised anvil surface projects from the anvil member toward the sheet material;

a roller having a peripheral roller surface;

the roller and the anvil surface being mounted for relative movement therebetween such that the roller surface is moved in a direction of rolling movement along the anvil surface while the roller rotates about an axis generally at a right angle to the direction of rolling movement;

the roller being arranged for applying pressure between the roller surface and the raised anvil surface so as to compress the sheet material between the roller surface and the raised anvil surface;

the roller surface being wider than the raised anvil surface and such that the roller surface applies a pressure to the sheet material pressing the sheet material onto the raised anvil surface to form a pinching action of the sheet material on the raised anvil surface;

and the raised anvil surface being arranged such that the pinching action causes the raised anvil surface to engage into and effect cutting of the sheet material along the cutting line.

15. The apparatus according to claim 14 wherein the raised anvil surface is free from a sharpened edge.

16. The apparatus according to claim 14 the raised anvil surface is curved in transverse cross-section.

17. The apparatus according to claim 14 wherein the raised anvil surface is arcuate in transverse cross-section.

18. The apparatus according to claim 14 wherein the roller is mounted on a carriage movable along the anvil member.

19. The apparatus according to claim 18 wherein the roller is spring biased toward the anvil surface by a spring mounted on the carriage.

20. The apparatus according to claim 18 wherein the anvil member includes a rigid elongate bar and wherein the carriage includes a pair of side members straddling the elongate bar.

21. The apparatus according to claim 20 wherein each of the side members includes a ramp surface for engaging and lifting the sheet material.

22. Apparatus for cutting sheet material comprising:

an anvil member having an substantially cylindrical wire thereon defining a cutting line lying on the anvil member and supported thereby and arranged such that, with the sheet material lying stationary across the anvil member, the raised wire projects from the anvil member toward the sheet material;

a roller having a peripheral roller surface;

the roller and the wire being arranged for relative movement therebetween such that the roller surface is moved in a direction of rolling movement along the wire while the roller rotates about an axis generally at a right angle to the direction of rolling movement;

the roller being arranged for applying pressure between the roller surface and the wire so as to compress the sheet material between the roller surface and the wire;

the roller surface being wider than the wire such that the roller surface applies a pressure to the sheet material pressing the sheet material onto the wire to form a pinching acion of the sheet material on the wire;

and the wire being arranged such that the pinching action causes the wire to engage into and effect cutting of the sheet material along the cutting line.

23. The apparatus according to claim 22 wherein the roller is mounted on a carriage movable along the anvil member.

24. The apparatus according to claim 23 wherein the roller is spring biased toward the wire by a spring mounted on the carriage.

25. The apparatus according to claim 23 wherein the anvil member includes a rigid elongate bar and wherein the carriage includes a pair of side members straddling the elongate bar.

26. The apparatus according to claim 25 wherein each of the side members includes a ramp surface for engaging and lifting the sheet material.

* * * * *